United States Patent [19]

Josza

[11] Patent Number: 4,502,907

[45] Date of Patent: Mar. 5, 1985

[54] DEVICE FOR THE MANUFACTURE OF NATURAL LOOKING MODEL RAILWAY TRACKS

[75] Inventor: Janos Josza, Hisings Backa, Sweden

[73] Assignee: Jomo Jigs AB, Odsmal, Sweden

[21] Appl. No.: 558,520

[22] Filed: Dec. 6, 1983

[30] Foreign Application Priority Data

Dec. 8, 1982 [SE] Sweden ..... 8206988

[51] Int. Cl.[3] ..... B27H 6/00

[52] U.S. Cl. ..... 156/349; 156/60; 156/65; 269/289 R

[58] Field of Search ..... 156/443, 65, 349, 60; 269/55, 289 R

[56] References Cited

U.S. PATENT DOCUMENTS

| | | | |
|---|---|---|---|
| 2,205,003 | 6/1940 | Walters | 156/101 |
| 3,307,988 | 3/1967 | Berg | 156/349 X |
| 3,518,137 | 6/1970 | Hamilton | 156/391 |
| 3,879,026 | 4/1975 | Lappin | 269/55 |
| 4,157,140 | 6/1979 | Glasgow | 156/99 |

FOREIGN PATENT DOCUMENTS 2803268 8/1979 Fed. Rep. of Germany .

*Primary Examiner*—David Simmons
*Attorney, Agent, or Firm*—Holman & Stern

[57] ABSTRACT

A device for the manufacture of natural looking model railway tracks consisting of a number of retainer members (13) with means (15) for retaining two track rails in mutually spaced apart positions, and at least one flexible, elongated interconnecting member (12) adapted to interconnect said retainer members, said interconnecting member/s (12) thereby being designed with mainly the same flexural resistance in all directions, and adapted to be bendable to optional angular positions relative to the retainer members in order to allow bending of the interconnecting member, and thereby also the rails in more than one plane, and said interconnecting member/s furthermore being adapted to maintain or being able to be brought to maintain its curvature after the flexing force being relieved.

16 Claims, 6 Drawing Figures

DEVICE FOR THE MANUFACTURE OF NATURAL LOOKING MODEL RAILWAY TRACKS

BACKGROUND OF THE INVENTION

The invention relates to a device for the manufacture of natural looking model railway tracks and of the type incorporating a plurality of retainer members with means for retaining two track rails in mutually spaced apart positions, and at least one flexible, elongated interconnecting member adapted to interconnect said retainer members.

Such devices are used for building model railway tracks when it is desired to make an individual choice of the curve of the track, in contrast to what is possible with fixed fixtures available in the market, by means of which it is possible to build tracks of predetermined curvature only At such devices the rails are located in the retainer members, whereupon said interconnecting member, preferably manually, is given the curvature desired for the track in question. The interconnecting said retainer members are mutually locked in this position, wherupon crosstie members are glued to the rails which are thus bent to desired shape. When the glue joints have become dry the thus completed and individually curved track is made loose and removed from the device.

German DOS No. 28 03 268 describes such a device, the retainer members of which are two-part elements, which with screw joints are screwed together thus that the rod-shaped interconnecting members, which have considerably bigger height than width, are clamped between the two parts of the retainer member. One of the parts has seats for the track rails, which are clamped thereto by means of especial screw-operated clamping jaws.

The device according to this publication is a good aid for the building of model railway tracks, which are optionally curved in one plane, even if the device comprises several parts and has rather a complex design, whereby it is difficult to use and also expensive. The design furthermore means that it in practice is impossible to make bends of the track other than sideways, whereby it is possible to make conventionally curved tracks only. It is however a desire to build as natural looking model railway tracks as possible, whereby it is required that the tracks can be bent also in other planes, whereby natural upward slopes, bankings and the like can be made separately as well as in combination with other bendings.

This can not be achieved with the device according to the German publication or with other known earlier devices of this kind, as these can be bent in one plane only if they shall maintain their function. The building of models must therfore with aid of the earlier devices be adapted to landscape models with tracks in one plane in contrast to natural conditions where several different planes of curvature can occur.

THE PURPOSE AND MOST IMPORTANT FEATURES OF THE INVENTION

The purpose of the present invention is to provide a device for the manufacture of natural looking model railway tracks and of the type incorporating a plurality of retainer members with means for retaining two track rails in mutually spaced apart positions, and at least one flexible, elongated interconnecting member adapted to interconnect said retainer members, by the aid of which device, in artibrary manner, tracks curved in any optional plane can be made, and this is achieved thereby that the device is designed in accordance with the characterizing part of the accompanying claim 1.

DESCRIPTION OF THE DRAWINGS

The invention hereinafter will be further described with reference to embodiments shown in the accompanying drawings.

DESCRIPTION OF EMBODIMENTS

Figure 1:
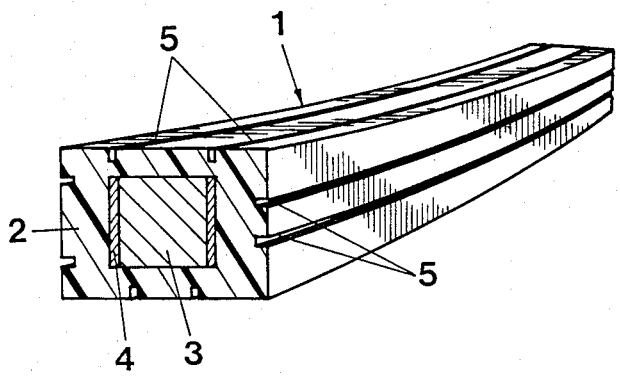
FIG. 1 shows in perspective a first embodiment of a device according to the invention.

FIG. 1 shows in perspective and schematically a portion of a device 1 according to the invention. This device which is the most simple conceivable variant incorporates a one-piece interconnecting and retainer member 2, consisting of a rod having a four-sided cross section with a core 3, which is so shaped and made from such a material that it is rather easy to bend in all directions. By using a core of a pliable material which is permanently deformable, e.g. lead, it is achieved that the device after having been bent to the desired direction, to a considerable extent will maintain its curvature when the bending force terminates. In order to increase the rigidity somewhat the thus permanently deformable core 3 can be provided with more rigid side pieces 4 of proper material. The core 3 and the possible completments 4 is enclosed in a proper outer shell, preferably made from a plastics. At least one of the surfaces of the shell and in the embodiment shown, all surfaces, are provided with pairs of parallel grooves 5, intended to receive one not shown track rail each for the model railway track to be built in the device. By the fact that several of the surfaces of the device can be equipped with retainer members formed as grooves 5 in different mutual distances is it possible with such a device to build railway tracks with all occuring track gauges.

Figure 2:
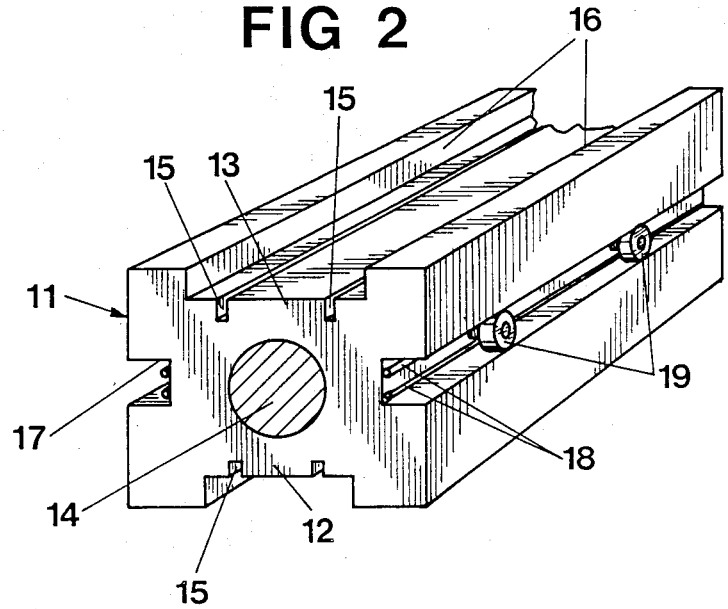
FIG. 2 is a perspective view of a second embodiment of the invention.

In FIG. 2 is shown a second embodiment of a device 11 according to the invention. This device is designed with an elongated interconnecting member 12 with an retainer member 13 made integrally therewith and in this embodiment extending along all of the interconnecting member surface. The interconnecting member can alternatively be equipped with a number of mutually spaced apart retainer members having the same function as the single retainer member 13, and this or these retainer member/s may also be designed as separate parts which in appropriate manner can be attachable to and lockable in desired positions along the beam-shaped interconnecting member. The interconnecting member 12 is preferably made from a strong plastic material but which at the same time is easily bendable in all directions. A longitudinal core 14 is located in the interior of member 12 in correspondence with the device in FIG. 1, and which core like the surrounding material at one hand is easily bendable in all directions, which can be achieved by choice of dimensions and material thus that mainly the same flexural resistance in all directions is obtained, and which on the other hand has the ability after bending to maintain its curvature when the bending force is relieved. This can be achieved e.g. with a lead core, possibly reinforced with not shown springy inserts.

The retainer member 13, which has a mainly parallelepipedic cross-sectional contour, is on at least one of its sides provided with spaced apart longitudinally extending parallel grooves 15, intended to serve as retaining means for not shown track rails. The pairs of grooves 15 in the embodiment shown are arranged in a recessed portion of the surface of the retainer 12, whereby the surrounding flanges 16 form stop faces for crosstie members, which shall be located in the device for being glued to the track rails.

In order to ascertain that the curvature is maintained after the bending force has terminated, the device in this embodiment is equipped with longitudinal metal threads 18, received in longitudinal recesses 17 in the side surfaces, i.e. the surfaces adjacent to the groove-equipped retainer surfaces, which threads are intended to reinforce the entire profile and to be lockable to interconnecting and retainer members 12, 13 by means of through bolts 19. By letting these threads be freely movable during the bending of the device and thereafter locking them by tightening a nut on each bolt 19 the threads will be locked in the curved position of the device and they will therefore prevent the device can take up another curvature until the bolts are unfastened again.

Figure 3:
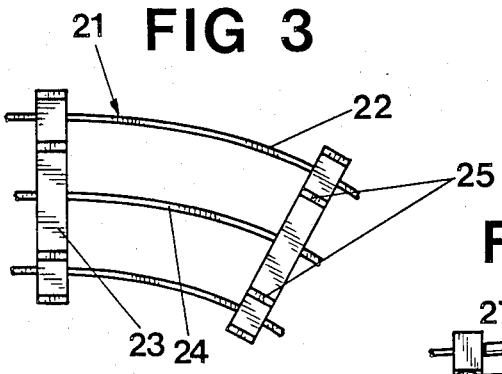
FIGS. 3 and 4 show in a view from above and from the side resp. different bendings of a third embodiment of the device according to the invention.
Figure 4:
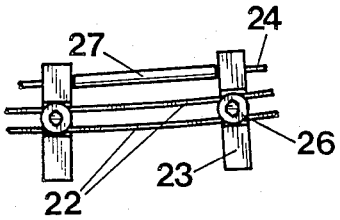

FIGS. 3–6 show in different views a third embodiment of a device 21 according to the invention, whereby FIG. 3 in a planar view from above shows a portion of the device with interconnecting members 22 and two retainer members 23 in a laterally curved condition. The device is furthermore provided with a further interconnecting member 24, located between the other interconnecting members 22, substantially right between the grooves 25 arranged in the upper surface of the blocks and serving as retainer means. FIG. 4 shows in a corresponding manner a portion of the device in a side elevation in which the interconnecting members are curved upwards, and from this can be seen that the additional interconnecting member furthermore is located above the other interconnecting members.

The interconnecting members are in this case five threads 22 with a round or other appropriate cross-section, which has mainly the same flexural resistance in all directions. The retainer members 23 are block shaped and even if the figure shows only two blocks is it to be understood that a device incorporates about 10 such blocks. Due to the interconnecting members 22 and 24 being located thus that they lie rather far away and are not aligned, the bending possibility will be great whereby curves as well laterally as vertically can be made as well as combinations of lateral and vertical curves, bankings and the like.

FIG. 4 shows how the interconnecting members 22 are locked to the retainer members 23 by bolts 26, in a similar manner as that at the embodiment according to FIG. 2. The additional interconnecting member 24 is adapted to project through a hole in the retainer member and it is preferably provided with a bush 27, which serves as a spacing member between two adjacent retainer members.

Figure 5:
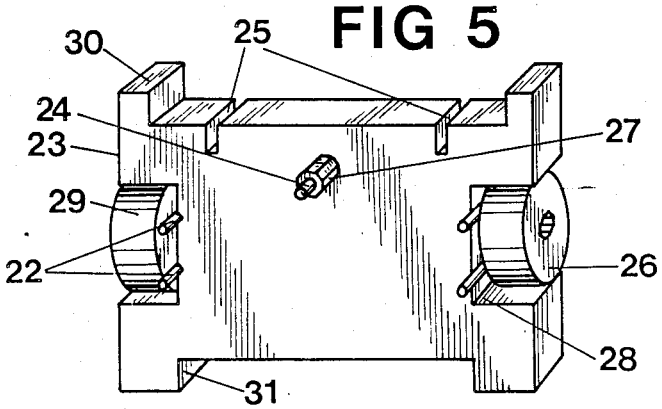
FIG. 5 shows in perspective a retainer member forming part of ther device according to FIGS. 3 and 4.

FIG. 5 shows in perspective and bigger scale a retainer member 23 with small portions of the associated interconnecting members 22 and 24. The retainer members 22 are held in recesses 28 on two opposite side surfaces, which are adjoined to the surface which carries the retainer means 25, by means of a through bolt 26, which at one side clamps the members 22 between its head and the bottom of the recess, whereas the members 22 at the opposite side in a similar manner are arrested between a nut 29 tightenable upon the bolt and the bottom of the other recess. The surface of the block 27, which is equipped with grooves 25 is provided with raised edge flanges 30, which guide the crosstie members which shall be glued to the rails (not shown) retained in the grooves 25, whereby the assembly is facilitated. In order further to facilitate the building it is preferable to use prefabricated units of several crosstie members, but the device can as well be used with separate crosstie members.

At the bottom of the retainer member 23 there is a recess 31 intended to be used together with fixed rulers or templets, which can be curved as standard curves, but straight rulers can also be used as it may be more easy to give the device a straight extension with aid of a ruler, when the device before that has been curved.

Figure 6:
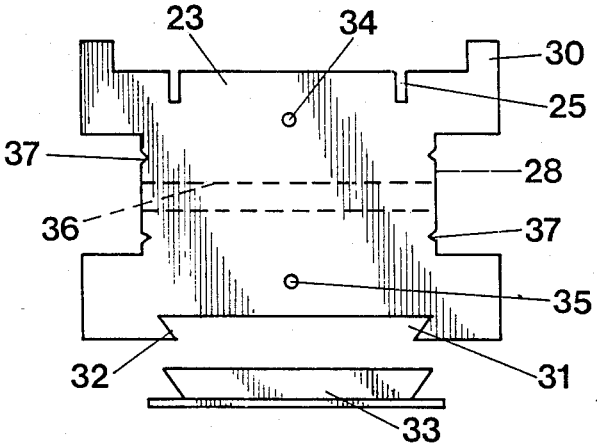
FIG. 6 is a planar elevation of a retainer member which is sligthly modified in comparison with FIG. 5.

In FIG. 6 is shown in a planar view a retainer member 23 of the same kind as that in FIG. 5, but the recess 31 at the bottom of the member has here been provided with undercut side walls 32, whereby a correspondingly formed ruler 33 can be made to press in the recess 31 and thereby give a more rigid guiding of the device. Beside the hole 34 for the additional interconnecting member there is a further through hole 35 located at a distance away from the first hole 34 and intended to receive still another interconnecting member. In the recesses 28 there are at each side of the intimated bolt hole 36, shaped seats 37 for receiving the first interconnecting members 22.

By means of the device according to the invention such as described in three different embodiments is achieved a very good possibility of bending the glueing fixture in all planes, which was not possible with earlier known devices of this kind. The device according to the invention is furthermore simple both to use and to produce, whereby the production cost will be low as compared to earlier devices.

The invention is not limited to the embodiments shown on and described in connection to the drawings but variations are possible within the scope of the accompanying claims.

I claim:

1. A device for the manufacture of natural looking model railway tracks and of the type incorporating a plurality of retainer members with means for retaining two track rails in mutually spaced apart positions, and at least one flexible, elongated interconnecting member adapted to interconnect said retainer members, characterized therein, that said interconnecting member/s is/are designed with mainly the same flexural resistance in all directions, and adapted to be bendable to optional angular positions relative to the retainer members in order to allow bending of the interconnecting member, and thereby also the rails in more than one plane, and that said interconnecting member/s is/are adapted to maintain or can be brought to maintain its curvature after the flexing force being relieved.

2. A device according to claim 1, characterized therein, that said interconnecting member is an elongated bar adapted to carry said retainer members and made from a material, which allows the bar to be easily permanently deformed to different curvatures and angular positions between the retainer members.

3. A device according to claim 2, characterized therein, that the interconnecting member consists of a core of a material which can be permanently deformed, e.g. lead, and which is coated with a proper surface material.

4. A device according to claim 2, characterized therein, that the retainer members are designed integrally with the interconnecting member.

5. A device according to claim 2, characterized therein, that the bar-shaped interconnecting member is provided with at least one external, tightenable reinforcing member arranged to be lockable in order to increase the ability of the interconnecting member to maintain the curvature given to it.

6. A device for the manufacture of model railway tracks according to claim 1, wherein the retainer members are lockable to interconnecting members in optional positions, characterized therein, that the interconnecting members are lockable to the retainer members in at least three, mutually spaced apart points, which are not aligned, and that the retainer members are lockable to the interconnecting members in optional angular positions relative thereto, for allowing bending of the interconnecting members and thereby the rails in more than one plane.

7. A device according to claim 1, characterized therein, that the retainer members are provided with at least one recess for insertion of an aligning ruler having an optional curvature.

8. A device according to claim 7, characterized therein, that the sides of the recess are undercut.

9. A device according to claim 6, characterized therein, that at least one of said interconnecting members is arranged to extend through a hole in each retainer member, whereas the other interconnecting member/s by means of clamping members are clampable against the surface of the retainer members.

10. A device according to claim 9, characterized therein, that the retainer members are of mainly parallelepipedic shape, whereby the interconnecting members which are clampable against the surface of the retainer members, are arranged at opposed end surfaces, both of which are adjacent to an end surface provided with grooves for rails.

11. A device according to claim 10, characterized therein, that the clamping member is a screw, which extends between the end surfaces carrying the interconnecting members, whereby the interconnecting members in locked positions are clamped between the screw head and the surface of the retainer member on one side and between a nut which is tightenable on the screw, and the opposite surface of the retainer member on the other side.

12. A device according to claim 11, characterized therein, that the retainer member is provided with groove-shaped seats for the interconnecting members to be clamped to the retainer members.

13. A device according to claim 1, characterized therein, that spacing members are arranged to maintain a constant space between the centres of adjacent retainer members.

14. A device according to claim 13, characterized therein, that said spacing member is a bush arranged over at least one interconnecting member projecting through a hole in the retainer members.

15. A device according to claim 1, characterized therein, that the means for retaining rails are grooves cut into at least one surface on the retainer members and being somewhat deeper than the height of the web of a rail.

16. A device according to claim 1, characterized therein, that the interconnecting members are exchangeably fitted to the retainer members.

* * * * *